United States Patent [19]

Alms et al.

[11] 4,140,248

[45] Feb. 20, 1979

[54] END GATE POSITIVE CLEANOUT

[75] Inventors: Erhard E. Alms, Barrington; James E. Mitchell, Algonquin, both of Ill.

[73] Assignee: AFE Industries, Inc., Lake Zurich, Ill.

[21] Appl. No.: 776,265

[22] Filed: Mar. 10, 1977

[51] Int. Cl.[2] ..... B67D 1/08

[52] U.S. Cl. ..... 222/148; 222/185; 222/561

[58] Field of Search ..... 222/148, 561, 363, 185

[56] References Cited

U.S. PATENT DOCUMENTS

| | | | |
|---|---|---|---|
| 2,869,480 | 1/1959 | Batho | 222/561 X |
| 2,901,148 | 8/1959 | Cunningham et al. | 222/185 |

*Primary Examiner*—Allen N. Knowles

*Attorney, Agent, or Firm*—Hill, Gross, Simpson, Van Santen, Steadman, Chiara & Simpson

[57] ABSTRACT

An end gate cleanout apparatus which includes a plurality of slidable trays that can be connected end to end and moved into the bottom of a grain dryer or other apparatus and including driving means for removing or inserting such removable troughs so as to allow material to fall from the dryer.

11 Claims, 5 Drawing Figures

END GATE POSITIVE CLEANOUT

BACKGROUND OF THE INVENTION

1. Field of the Invention

This invention relates in general to grain dryers and in particular to a novel method and apparatus for cleaning the residue from a grain dryer.

2. Description of the Prior Art

Residue has a tendency to accumulate in the bottom of grain dryers and it has been time consuming to clean such material from the bottom of the dryer.

SUMMARY OF THE INVENTION

The present invention provides a slidable trough at the bottom of a grain dryer which can be inserted or removed from the grain dryer in sections with an external driving handle and wherein the trough is divided into longitudinal sections which can be removed as the trough is removed from the dryer and which can be attached as the trough is inserted into the dryer.

The bottom of the grain dryer beneath the trough is open so that when the trough is removed the residue material in the dryer will fall from the dryer and when the trough is reinserted the dryer is free of such residue.

A feature of the invention is the provision for apparatus and method for rapidly and simply removing residue from a grain dryer.

Other objects, features and advantages of the invention will be readily apparent from the following description of certain preferred embodiments thereof, taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
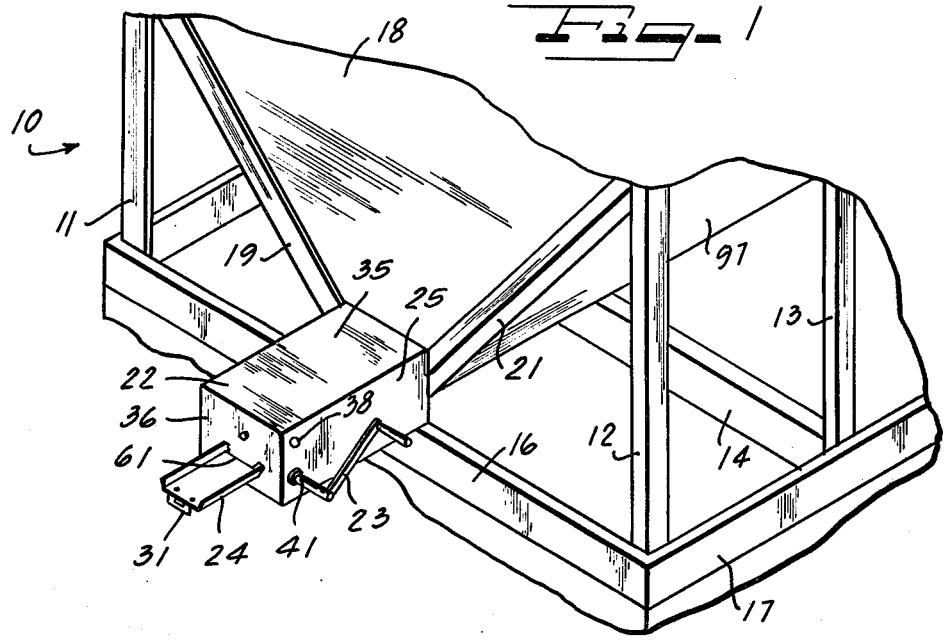
FIG. 1 is a partial cut-away of a grain dryer with the invention installed therein.

FIG. 1 is a partial cut-away view of a grain dryer 10 with the invention 22 attached thereto. The grain dryer has an end wall 18 and vertical supporting frame members 11, 12 and 13 and cross-frame members 14 and 16. Upwardly and outwardly extending frame members 19 and 21 support the side walls 96 and 97 of the dryer.

Figure 2:
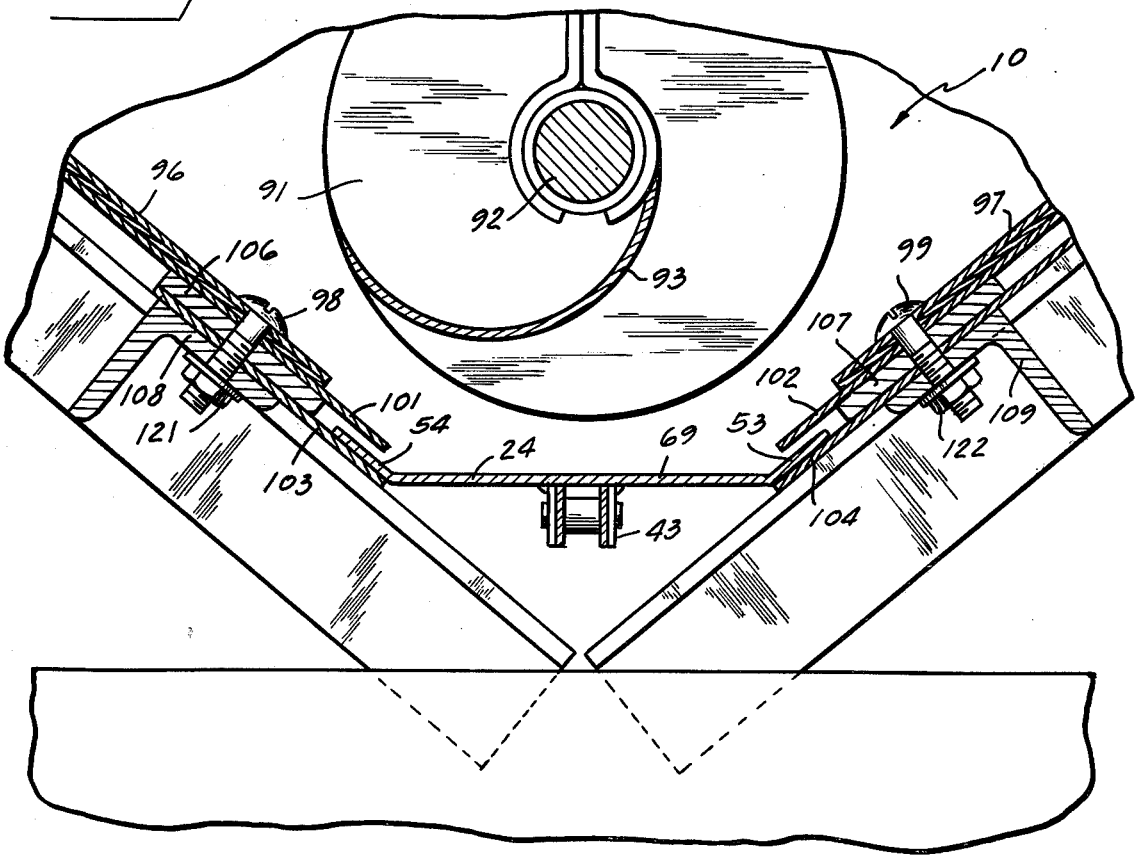
FIG. 2 is a sectional view illustrating the invention.

FIG. 2 is a sectional view through the grain dryer 10 and illustrates an auger 91 which is mounted on a supporting shaft 92 and has spiral grain moving member 93 which is mounted above the bottom of the dryer and inside thereof between the side walls 96 and 97 as shown. The auguer 91 moves grain longitudinally of the dryer. The invention provides a plurality of troughs which are mounted beneath the auger 91 within the grain dryer 10 and join the side walls 96 and 97 of the dryer so that the grain is supported within the dryer. As shown in sectional view, the side walls 96 and 97 have lower ends which do not meet and a plurality of troughs 24 according to the invention close this area. The trough 24 has a bottom planar portion 69 and upwardly extending lips 53 and 54 at opposite sides thereof which are received in guides attached to the side walls 96 and 97. For this purpose, bolts 98 and 99 extend through the side walls 96 and 97, respectively, near their lower edges and extend through planar top guide members 101 and 102, spacers 106, 107 and bottom slide guides 103 and 104, respectively. Angle iron members 108 and 109 are formed with openings and the bolts 98 and 99 extend therethrough and are secured with nuts 121 and 122 as shown so as to provide the upper and lower slide guides 101, 103, 102, 104 for the lips 54 and 53 of the troughs 24.

Figure 3:
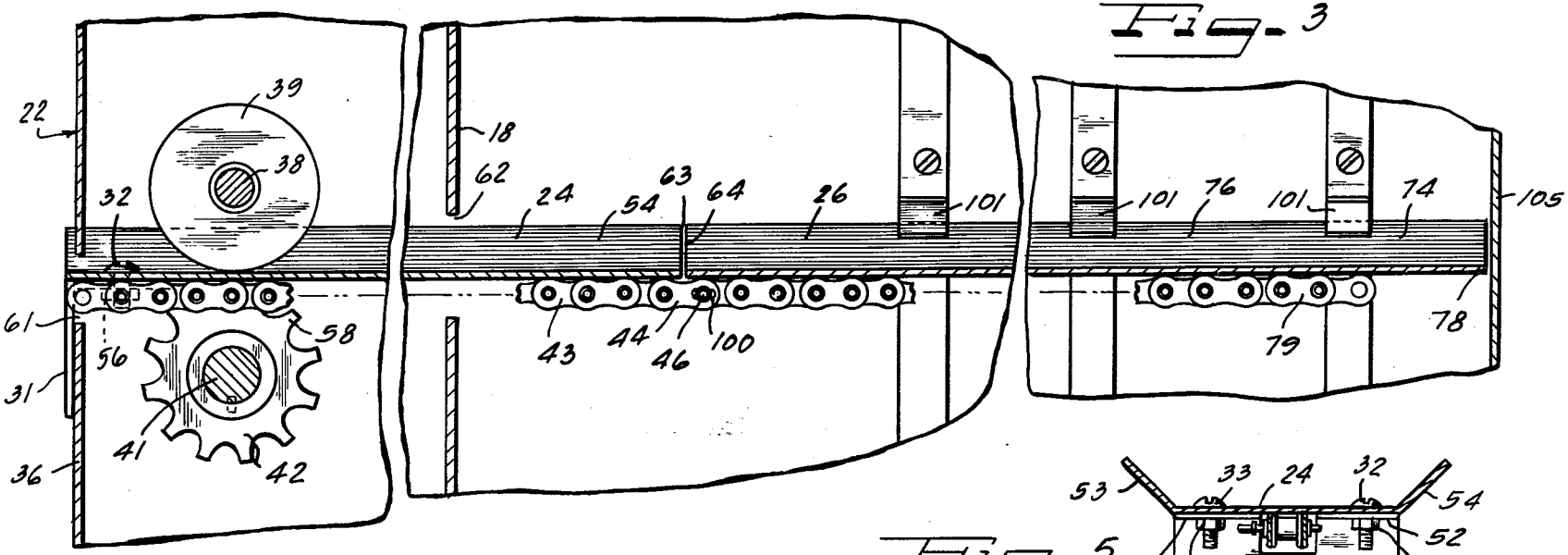
FIG. 3 is a side sectional view illustrating the invention.
Figure 5:
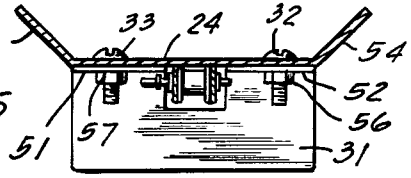
FIG. 5 is a sectional view through one of the troughs of the invention.
Figure 4:
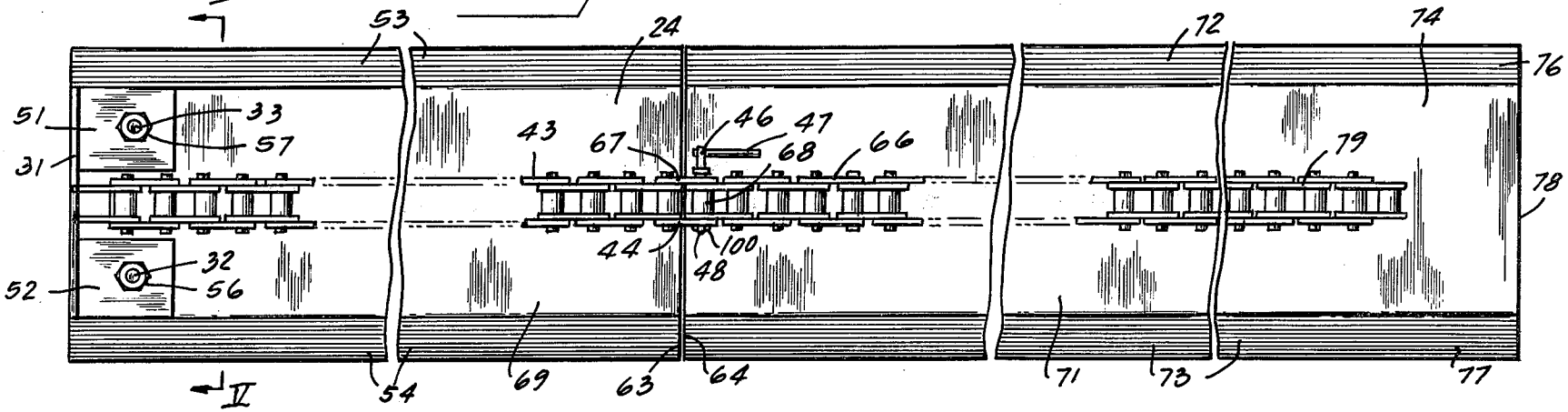
FIG. 4 is a bottom view illustrating the invention.

As best shown in FIGS. 3, 4 and 5, the housing 22 of the invention is attached to the end wall 18 of the grain dryer and has a top 35 and side walls 25 and an outer end wall 36 in which a slot 61 is formed through which the trough 24 can be inserted and withdrawn from the machine. A crank shaft 41 is supported between side walls 25 and the opposite side wall of the housing 22 and a crank 23 is attached thereto as shown in FIG. 1. A sprocket wheel 42 provided with a plurality of teeth 58 is fixed to the crank shaft 41 and the sprocket teeth 58 are engageable with bicycle links 43 which are attached as by welding to the bottoms of the trough 24. A shaft 38 is mounted above the crank shaft 41 and parallel thereto and carries a roller 39 which engages the upper surface of the trough so as to hold the bicycle or roller chain links 43 in engagement with the sprocket teeth 58 of the sprocket 42.

The trough is made in a plurality of sections and includes a front section 24 and a rear section 74 and one or more intermediate sections 26. As shown in FIGS. 3, 4 and 5, the front section 24 is provided with a stop member 31 which extends downwardly so that it engages the front wall 36 below the horizontal slot 61 so as to limit the inward motion of the front trough 24 into the machine. The stop 31 is provided with horizontal members 51 and 52 as shown in FIG. 4 through which bolts 33 and 32 extend and upon which nuts 56 and 57 are mounted. The bolts and nuts attach the stop member 31 to the trough 24. The front trough 24 can be detachably connected to an intermediate trough 26 by means including a pair of links 44 and 67 which extend beyond the end 23 of the trough 24 and a removable connecting pin 46 can be inserted through openings formed in the links 67 and 44 and through an opening formed in bicycle chain link 68 attached to the bottom of the intermediate trough 26 so as to provide a connection between the end trough 24 and the intermediate trough 26. The pin 46 may be provided with a compressible spring loaded ball 100 such that after it is inserted through the links 67 and 44 as well as the link 68 of the trough 26 the pin 46 will be positively held in the connecting position until spring loaded ball 100 is depreseed by pulling on the handle 47 to disconnect the troughs 24 and 26. Similar connections are made between the bicycle chain links 66 and corresponding chain links of the adjacent intermediate trough as well as between the last intermediate trough and the end trough 74. The end trough 74 is formed with lips 76 and 77 and the bicycle or roller chain 79 does not extend clear to the end 78 of the rear trough 74 as shown in FIG. 4.

As shown in FIG. 3, the end 78 terminates adjacent the end wall 105 of the dryer.

In operation, assuming that none of the trough sections are in place in the dryer, the rear section 74 is inserted with the end 78 passing through the slot 61 until the sprocket teeth 58 engage the chain link 79 and the roller 39 engages the bottom portion of the trough. Then the handle 23 is rotated clockwise relative to FIG. 3 so as to move the rear section 74 through the slot 62 in the end wall 18 of the dryer. Then, externally of the end wall 22, the first intermediate trough 26 is connected to the rear trough 74 by inserting a connecting pin 46 through links such as 67 and 44 to join the two sections longitudinally and then the handle 23 is turned clockwise to move the intermediate trough into the housing 35 and into the dryer. It is to be realized that as the troughs 74 and 26 move into the dryer that the lips of the troughs are guided by the top slide guides 101 and 102 and the bottom slide guides 103 and 104 as shown in FIG. 2. Additional intermediate sections are connected and inserted into the machine until the trough extends substantially the entire length of the dryer and then the front trough section 24 is attached to the intermediate trough 26 with a pin 46 and inserted until the stop 31 engages the wall 36 as shown in FIG. 3. It is to be realized in the position illustrated in FIG. 3 that the end 78 of the rear trough 74 is closely adjacent the end wall 105 of the dryer. For removal of the trough, the handle 23 is rotated counterclockwise relative to FIG. 3 so as to remove the troughs from the dryer thus allowing the residue to fall from the dryer so the machine will be clean before reinserting the troughs.

Although the invention has been described with respect to preferred embodiments, it is not to be so limited, as changes and modifications may be made which are within the full intended scope as defined by the appended claims.

We claim as our invention:

1. A removable bottom trough structure for a grain dryer comprising an opening formed at the bottom of said grain dryer, a slidable trough mounted over said opening and moveable to a first position to cover said opening and to a second position to open said opening, wherein said trough is formed of two or more sections that can be joined together and moved end to end between said first and second positions, including means for detachably connecting said sections together, including means for moving said trough between said first and second positions, wherein said means for moving said trough comprises a driving wheel which engages the underside of said trough, wherein said driving wheel comprises a toothed sprocket and a plurality of linearly spaced teeth attached to the underside of said trough and engageable with said toothed sprocket and driven thereby, wherein said plurality of linearly spaced teeth are formed from a roller chain attached to said trough.

2. A removable bottom structure for a grain dryer according to claim 1 wherein said means for detachably connecting said sections together comprises a locking pin receivable through links of said roller chain to join said sections together.

3. A removable bottom trough structure for a grain dryer comprising an opening formed at the bottom of said grain dryer, a slidable trough mounted over said opening and moveable to a first position to cover said opening and a second position to open said opening, wherein said trough is formed of two or more sections that can be joined together and moved end to end between said first and second positions, including means for detachably connecting said sections together, including means for moving said trough between said first and second positions, wherein said means for moving said trough comprises a driving wheel which engages the underside of said trough, wherein said driving wheel comprises a toothed sprocket and a plurality of linearly spaced teeth attached to the underside of said trough and engageable with said toothed sprocket and driven thereby, including a hand crank connected to said toothed sprocket to drive it and including a roller mounted to engage said trough above said toothed sprocket.

4. A removable bottom trough structure for a grain dryer comprising an opening formed at the bottom of said grain dryer, a slidable trough mounted over said opening and moveable to a first position to cover said opening and to a second position to open said opening, and wherein said trough is formed of two or more sections having transverse and longitudinal dimensions that can be joined together so that their longitudinal dimensions are parallel in the longitudinal direction, means joining the sections together for movement between said first and second position.

5. A removable bottom structure for a grain dryer according to claim 4 including means for detachably connecting said sections together.

6. A removable bottom structure for a grain dryer according to claim 5 including means for moving said trough between said first and second positions.

7. A removable bottom structure for a grain dryer according to claim 6 wherein said means for moving said trough comprises a driving wheel which engages the underside of said trough.

8. A removable bottom structure for a grain dryer according to claim 7 wherein said driving wheel comprises a toothed sprocket and a plurality of linearly spaced teeth attached to the underside of said trough and engageable with said toothed sprocket and driven thereby.

9. A removable bottom structure for a grain dryer according to claim 8 including a hand crank connected to said toothed sprocket to drive it.

10. A removable bottom structure for a grain dryer according to claim 4 including stop means attached to at least one of said trough sections to limit its motion.

11. A removable bottom structure according to claim 4 including guide means attached to said dryer for receiving and guiding said trough.

* * * * *